US006471123B1

(12) United States Patent
Jensen

(10) Patent No.: US 6,471,123 B1
(45) Date of Patent: Oct. 29, 2002

(54) FOLDING CARTON WITH PRESSURE-ACTIVATED CLOSURE MECHANISM

(75) Inventor: Kurt Jensen, Lebanon, OH (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 09/964,082

(22) Filed: Sep. 26, 2001

Related U.S. Application Data

(60) Provisional application No. 60/235,285, filed on Sep. 26, 2000.

(51) Int. Cl.[7] ..... B65D 5/66; B65D 43/22

(52) U.S. Cl. ..... 229/125.37; 229/123.1; 229/141

(58) Field of Search ..... 229/123.1, 125.37, 229/125.39, 125.41, 136, 141; 53/416, 484, 491; 493/116, 117, 393, 394

(56) References Cited

U.S. PATENT DOCUMENTS

| | | | | |
|---|---|---|---|---|
| 2,994,467 A | * | 8/1961 | Evanstein | 229/141 |
| 3,079,066 A | | 2/1963 | Roop | |
| 3,256,941 A | | 6/1966 | Rivman | |
| 3,325,084 A | * | 6/1967 | Ausnit | 229/125.37 |
| 3,550,837 A | * | 12/1970 | Erb | 229/125.37 |
| 3,927,821 A | * | 12/1975 | Dunning | 229/198 |
| 4,405,066 A | | 9/1983 | Roccaforte | |
| 4,781,323 A | | 11/1988 | Elias | |
| 4,886,206 A | * | 12/1989 | Martinez | 229/123.1 |
| 5,103,980 A | | 4/1992 | Kuchenbecker | |
| 5,855,973 A | * | 1/1999 | Calvert et al. | 229/5.81 |
| 5,911,359 A | | 6/1999 | Stone et al. | |
| 5,947,368 A | | 9/1999 | Thresher et al. | |

FOREIGN PATENT DOCUMENTS

| | | | | |
|---|---|---|---|---|
| CA | 745.888 | | 11/1966 | |
| GB | 2208846 A | * | 4/1989 | 229/125.37 |

* cited by examiner

*Primary Examiner*—Gary E. Elkins
(74) *Attorney, Agent, or Firm*—Pitts & Brittian, P.C.

(57) ABSTRACT

A pressure-sensitive closure mechanism for a folded carton incorporates a pressure-sensitive tape having adhesive on one surface thereof disposed on a one side of a hinged lid panel, with the adhesive exposed through an opening in the lid panel and releasably engaging an outer surface of a flap-receiving panel. The hinged lid panel is formed by folding an inner lid panel over an outer lid panel. Both lid panels have openings. The pressure-sensitive tape is disposed between the two lid panels. When the lid is closed over the opening in the carton, the user applies pressure with his finger to the backside (non-adhesive) side of the pressure-sensitive tape. The pressure pushes the tape against flap-receiving panel of the carton. Repeated closings and openings are possible.

5 Claims, 4 Drawing Sheets

FOLDING CARTON WITH PRESSURE-ACTIVATED CLOSURE MECHANISM

CROSS-REFERENCE TO RELATED APPLICATIONS

This application is a Non-provisional application of Provisional Application Ser. No. 60/235,285 filed Sep. 26, 2000. Priority is claimed based on the aforesaid Provisional application Ser. No. 60/235,285.

BACKGROUND OF THE INVENTION

The invention relates to cartons and, more particularly to closure mechanisms for folding cartons. As used herein, a "carton" is a type of container which is formed of a substantially rigid, inextensible (substantially non-plastic or non-flexible) material such as "carton board" which is cut and folded to form a substantially three-dimensional structure which has the form of a rectangular prism having a length (or height), a width and a depth. A piece of carton board which has been cut and otherwise formed for use as a carton is referred to herein as a "carton blank". (A carton blank is also sometimes referred to as a "formed blank".) The cutting and forming of a piece of carton board typically involves die cutting. As used herein, "die cutting" refers to the process of cutting a sheet of material into a shape suitable for assembly into a carton.

As used herein, "carton board" is a heavy weight, sheet of paper or other fiber substance including paperboard, cardboard, fiberboard, containerboard, tagboard and corrugated board. The following materials are also known for use as carton board:

Solid Bleached Sulfate (SBS) is a premium grade of folding carton board, which is a solid sheet of paperboard manufactured from bleached kraft pulp, and which is generally clay-coated on one side.

Clay-Coated Recycled Boxboard (CRB): A key paperboard grade for folding cartons. CRB is made from recycled material—mainly, old newsprint and old corrugated containers—and coated with a layer of clay to provide a smooth white surface for packaging graphics.

Uncoated Recycled Board (URB): Uncoated paperboard grades manufactured primarily from old newsprint and old corrugated and used in both folding cartons and in the manufacture of paper tubes and cores. URB is typically made on cylinder machines and often referred to generically as cylinderboard.

As used herein, "paperboard" is a term used to describe a material which comprises laminated layers of paper. As used herein, "paper" is a general term used to describe sheets of intertwined plant fiber. Synthetic papers from mineral, animal, or synthetic materials can also be made. Paper and paperboard are non-specific terms which could be applied to either form. Paperboards used in packaging generally have a thickness between 0.010 and 0.024 inches (0.25–0.60 mm).

The present invention relates to folding cartons. As used herein, a "folding carton" refers to a general class of container which is distinct from either a rigid box or case. As discussed in greater detail hereinbelow, it is also distinct from a bag or envelope. The folding carton is typically a plain or printed container of paperboard, including both single and multi-layer paperboard, which is delivered either flat or folded, glued, and collapsed, to be erected, filled, and closed by the user. Folding cartons are designed to protect a product during shipment and on the store shelf, and to enhance the product's appeal to the consumer. Folding cartons typically feature high-quality graphics to maximize shelf appeal in a retail outlet and to provide information about the product and its use. The market is primarily consumer nondurable goods.

In order to facilitate folding a carton blank into a carton—in other words, assembling the carton from a carton blank, the carton blanks may also incorporate "creases" or "score lines". As used herein, a "score line" is a rupturing of the surface of blank paperboard sheet material, typically resulting in a depression on one side of the sheet and a welt on the other, which facilitates the paperboard blank being folded along that line. As used herein, to "score" a carton (or paperboard) blank is the act of making an impression or partial cut in a flat material for the purpose of facilitating bending, creasing, folding or tearing. A "folding score" in which the fibers of the carton board are compressed but not cut, helps ensure that a fold or bend takes place along the score line.

Sometimes, slits are formed in the material of the paperboard. As used herein, a "slit" comprises a cut which extends completely through the material of the paperboard to separate a one portion (e.g., panel) of the paperboard blank from another portion thereof. Sometimes, perforations are formed in the material of the paperboard. As used herein, a "perforation" is a series of slits, typically along a straight or curved line, extending completely through the material of the paperboard, typically for facilitating tearing along the line by a user. A type of "score" which functions much like a "perforation" is the "tearing score", in which the fibers of the carton board are cut approximately halfway through the carton board to permit tearing along the score lines. A tearing score can, of course, also function as a folding score.

A number of closure mechanisms are known for cartons. A one type of pressure-activated closure includes hook and loop material, which is bulky, expensive and difficult to apply automatically.

As described hereinabove, a carton is a type of packaging that uses relatively rigid (inflexible) materials. In contrast thereto, bags and envelopes are a type of "flexible packaging" that uses flexible material such as foils, films, paper, plastic films, laminates or sheeting to form a container which, when filled and closed, can be readily changed in shape.

Viewed from another perspective, a carton is a substantially three-dimensional container having a length (or height) H, a width W and a depth D. And, as used herein, the term carton is limited to containers having such dimensions which are substantially on the same order of magnitude (within one-tenth or ten times) each other. For example, a carton may have a depth dimension D of 1.0 inches (2.5 mm), and height H and width W dimensions which are each approximately 5 inches (12.5 mm). In other words, the depth dimension D of a "carton" (as the term is used herein) is a substantial fraction, such as greater than one-tenth of the lesser of the height H and width W dimensions.

Another type of container is the bag or envelope. As used herein, a "bag" or an "envelope" is a type of container which is formed of a substantially flexible material, such as lightweight paper or plastic which is generally formed as two rectangular sheets joined along three sides thereof, a one sheet extending beyond the remaining edge of the other sheet and forming a flap which is folded over to close the envelope or bag. The "thickness" of the resulting bag or envelope is substantially zero, considering that there is no distinct top or bottom panel, but rather merely a fold line defining where the flap portion of the panel begins. The sheet typically has a thickness which is less than 0.010 inches or 0.25 millimeters (mm). Whereas a carton is a substantially three-dimensional container, a bag or envelope is a substantially two-dimensional container having no substantial depth dimension. A number of closure mechanisms are known for bags or envelopes.

U.S. Pat. No. 3,079,066 discloses temporary sealing means permitting ready opening and reclosure of a bag (6). A closure flap (10) is provided with at least one opening (11) therethrough. A strip (12) is secured to the outer surface of the closure flap (10) in overlying relation to the openings (11). The strip (12) is provided on one side thereof with an adhesive layer (13) which may be of any tacky, non-permanent type adhesive. The tape (12) is secured to the closure flap (10) by means of the adhesive coating (13). When the closure flap (10) is in its bag-closing position, the strip (12) will have those portions thereof overlying the openings (11) depressed into the openings (11), with the adhesive layer (13) engaging the underlying portion of the body (7) of the bag (6).

U.S. Pat. No. 3,256,941 discloses a reclosable plastic bag (10) which is easily shut without heat-sealing, and which is easily opened without cutting or tearing. A flap (20) is provided with a series of mutually equidistant spaced holes (22). A strip (24) of polyethylene (or paper, or aluminum foil) which has pressure-sensitive adhesive coating (26) on one surface is applied to the rear surface of the flap (20). The adhesive coating (26) binds the strip (24) to the flap (20). To close the bag, the flap is folded and pressed against the front wall of the bag. The plastic bag is described as polyethylene, and various different flexible plastic materials can be used, including cellophane, paper and other traditional bag materials.

Canadian Patent No. 745,888 discloses an envelope having a closure flap which may adhere to the main body of the envelope, be pulled away from the envelope, and adhere again a plurality of times without losing its effectiveness of adherence. An envelope has a closure flap (2). Apertures (3,4,5,6,7,8,9) of different shapes are provided in the flap. An adhesive tape (10), such as the one known by the trademark "SCOTCH TAPE", is disposed on the outside surface of the flap, and the adhesive is exposed in the apertures. A peelable strip (11) is disposed on the inside surface of the flap to protectively mask the exposed adhesive, and is peeled off before sealing the flap. The portion of the envelope which will receive the closure flap is provided with a tape (12) having a relatively high glossy surface. When the exposed adhesive of the adhesive tape (10) comes in contact with the glossy surface of the tape (12), a good reliable bond exists, and when the closure flap is pulled away from the tape (12), the glossy surface retains very little or no tacky material from the adhesive tape (10).

SUMMARY OF THE INVENTION

It is an object of the invention to provide an improved construction for a folding carton and, more particularly, an improved closure mechanism for a folding carton.

It is another object of the invention to provide a closure mechanism for a folding carton which is low in profile, low cost, and which can readily be applied by automated machinery.

According to the invention, a pressure-sensitive closure mechanism is incorporated into a container which is a carton, preferably a folded carton. The closure mechanism incorporates a pressure-sensitive tape having adhesive on one surface thereof disposed on a one side of a hinged lid panel, with the adhesive exposed through an opening in the lid panel. The adhesive releasable engages an outer surface of a flap-receiving panel.

The carton which is used to illustrate the closure mechanism for this invention has a rectangular body with a hinged lid panels. The lid panel is preferably a double thickness (two plies) of paperboard material. These two plies are formed by folding over an additional inner lid panel, which is connected to an outer lid panel via a score or fold. Both plies of the lid have holes or voids cut into them that line up with each other. Before the lid panel is doubled over, a pressure-sensitive tape (or label) is placed over an opening in the inner lid panel. The lid panels are then doubled over to form one double ply lid. The outer edges of the tape or label are thus hidden from view for a clean appearance. When the lid is closed over the opening in the carton, the user applies pressure with his finger to the backside (non-adhesive) side of the pressure-sensitive tape. The pressure pushes the tape against the adjacent face of the carton. The lid (closure flap) is thus temporarily secured to the carton body. The adhesive on the tape is chosen such that upward force on the lid will break the bond between the tape and the carton face allowing the lid to be opened. Repeated closings and openings are possible.

The pressure-adhesive tape, which is the principal element of the closure mechanism of the present invention, is a relatively flexible element. Although some similar closure mechanisms are known for bags and envelopes, it is not obvious that such closure mechanisms would function well (if at all) on a carton. The flaps of the bags and envelopes are also very flexible. The flap of a carton is relatively inflexible (rigid). As mentioned hereinabove, cartons are quite different from bags or envelopes. A carton is a substantially rigid container, formed of a substantial material (c., at least 0.010 inch thick paperboard), and each of its (typically six) sides has substantial dimensions (within the same order of magnitude as the dimensions of another side). A carton, more particularly an empty carton, can thus readily support and balance itself on any of its sides (e.g., front, back, top, bottom, left, right). This is in marked contrast to a substantially flexible and/or two-dimensional (when empty) bag or envelope.

Other objects, features and advantages of the invention will become apparent in light of the following description thereof.

BRIEF DESCRIPTION OF THE SEVERAL VIEWS OF THE DRAWINGS

Reference will be made in detail to preferred embodiments of the invention, examples of which are illustrated in the accompanying drawings. The drawings are intended to be illustrative, not limiting. Although the invention will be described in the context of these preferred embodiments, it should be understood that it is not intended to limit the spirit and scope of the invention to these particular embodiments.

Elements of the figures are typically numbered as follows. The most significant digits (hundreds) of the reference number corresponds to the figure number. Elements of FIG. 1 are typically numbered in the range of 100–199. Elements of FIG. 2 are typically numbered in the range of 200–299. Similar elements throughout the drawings may be referred to by similar reference numerals. For example, the element 199 in a figure may be similar, and possibly identical to the element 299 in an other figure. In some cases, similar (including identical) elements may be referred to with similar numbers in a single drawing. For example, each of a plurality of elements 199 may be referred to individually as 199*a*, 199*b*, 199*c*, etc. Such relationships, if any, between similar elements in the same or different figures will become apparent throughout the specification, including, if applicable, in the claims and abstract.

Figure 1:
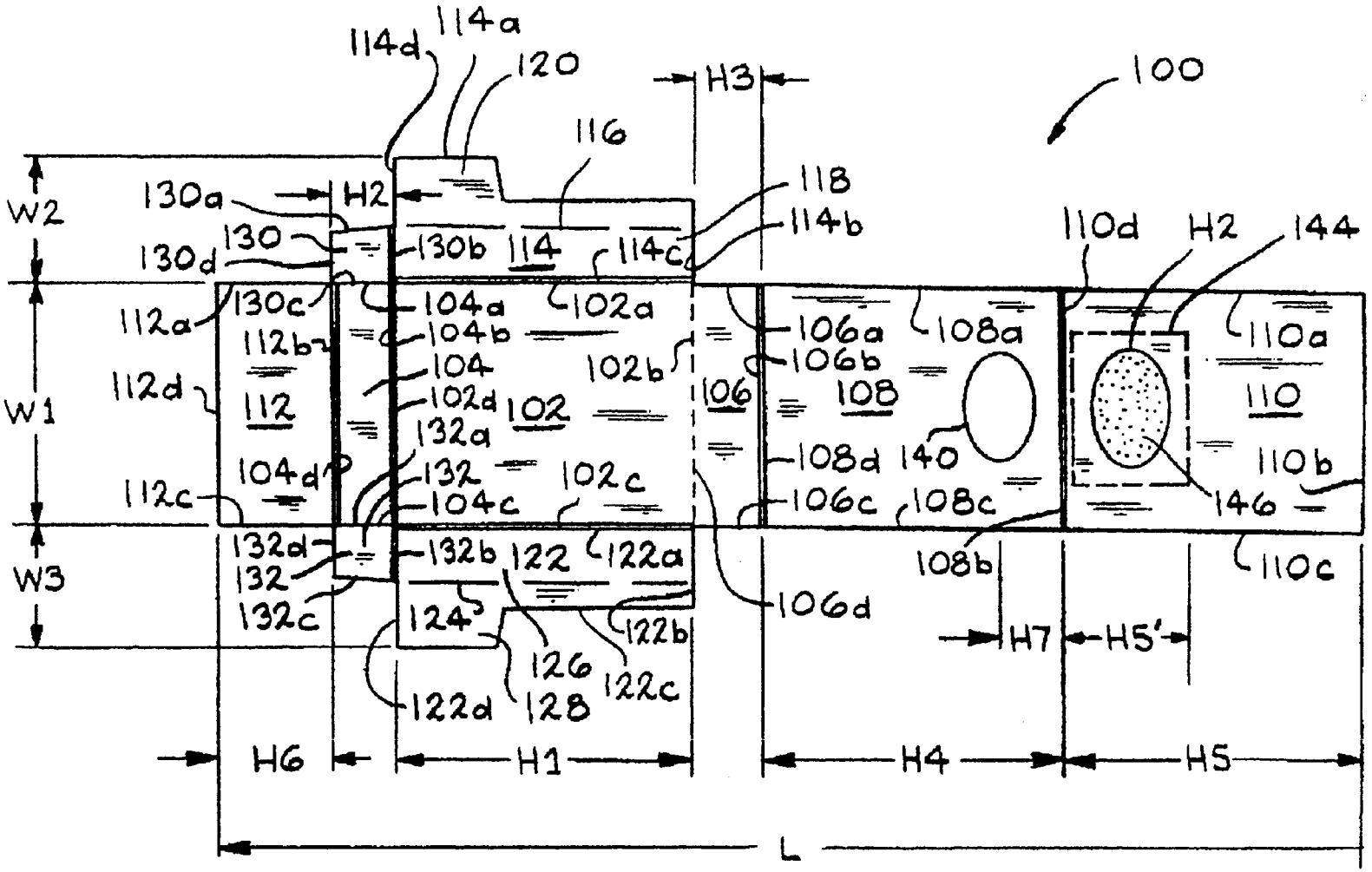

Throughout the following descriptions(s) of the drawings, the following terms may be used to describe and/or "point to" various portions of elements in the drawings. The terms "top", "upper", "bottom", "lower", "left" and "right" refer to directions on the Figure being discussed in its normal orientation. The terms "inside", "inner", "outside", and "outer" may also be used, and should be given their ordinary meanings, as consistent with the overall description, unless specified otherwise.

Figure 2:
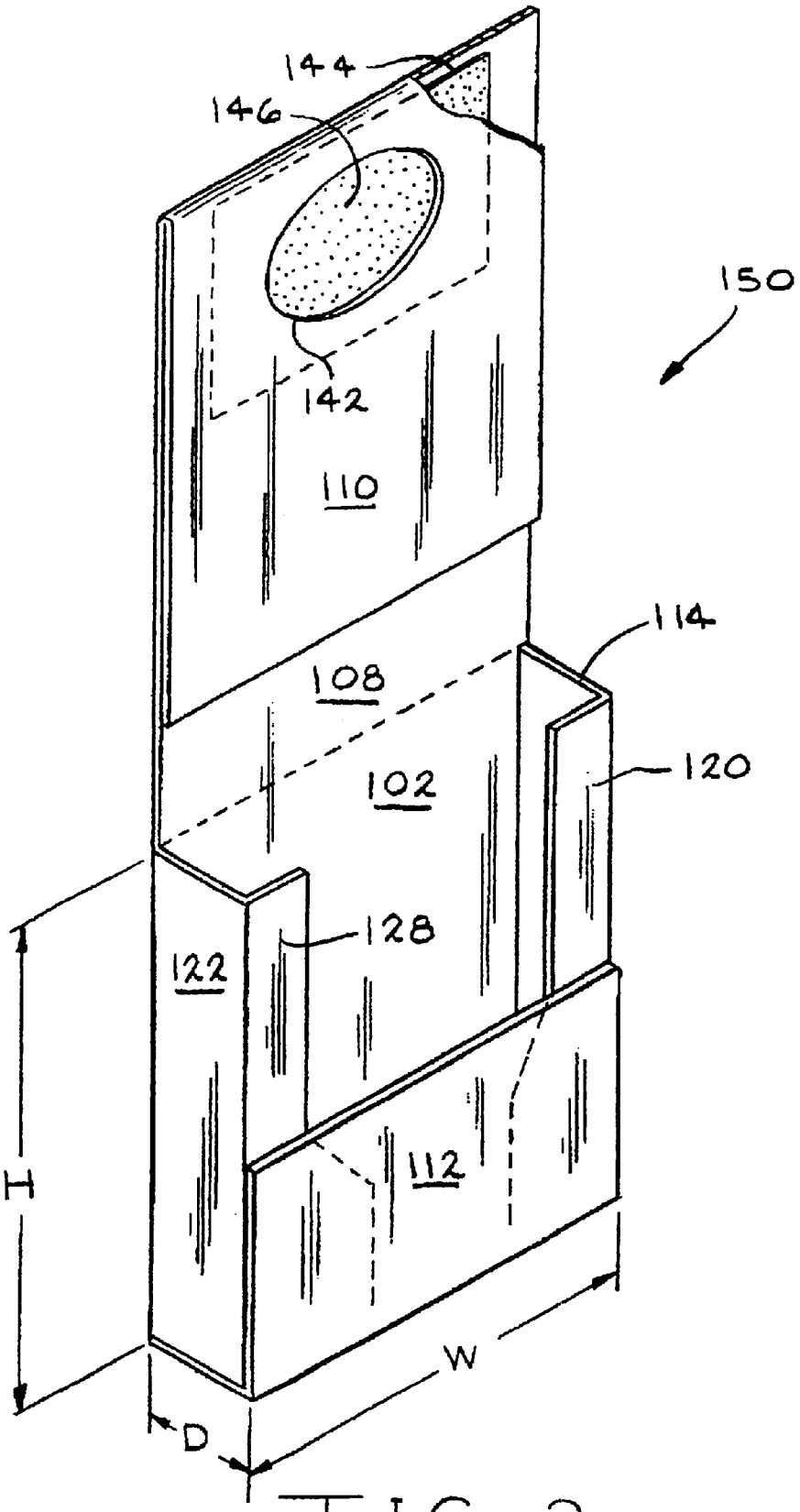
Figure 3:
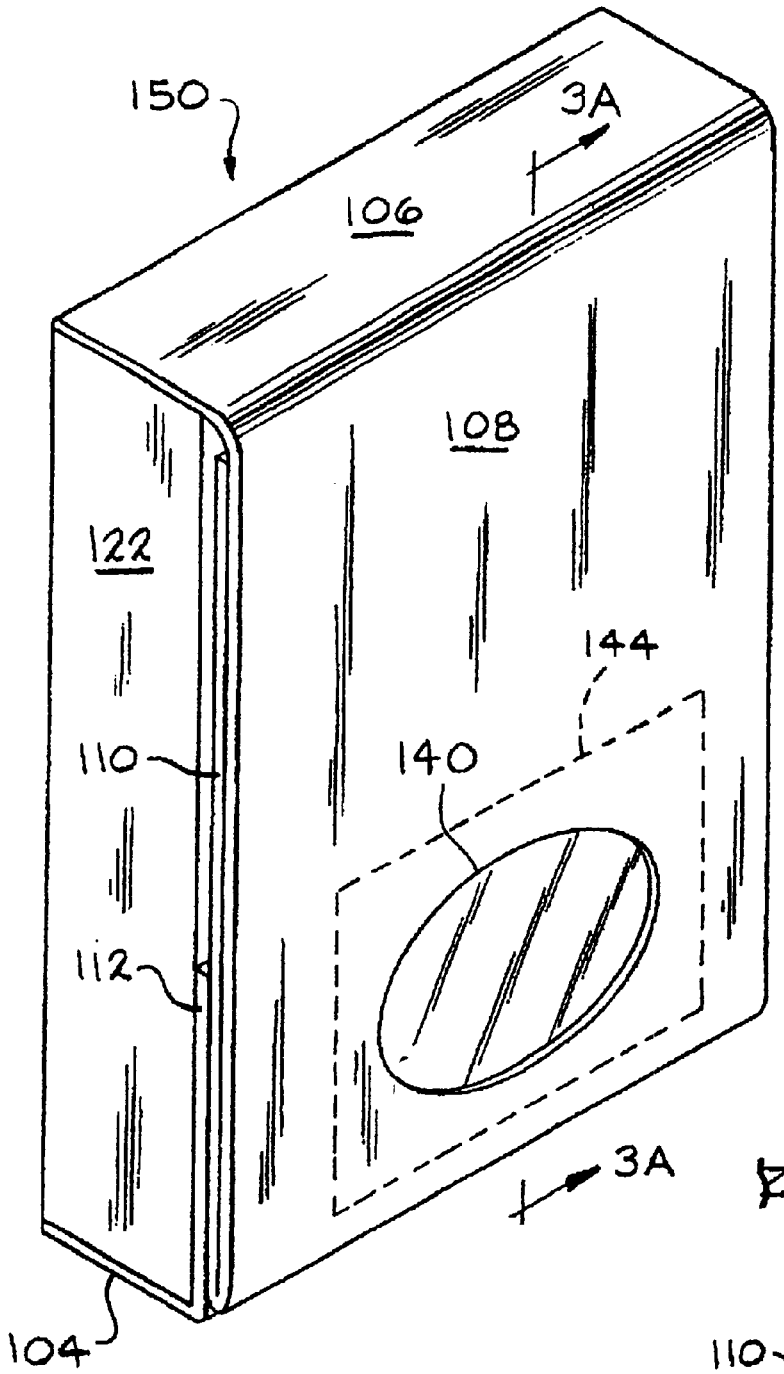
Figure 3A:
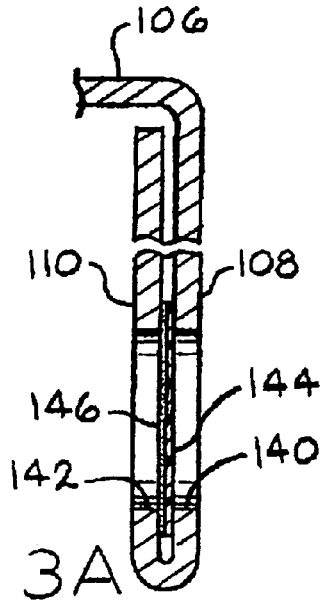
Figure 4A:
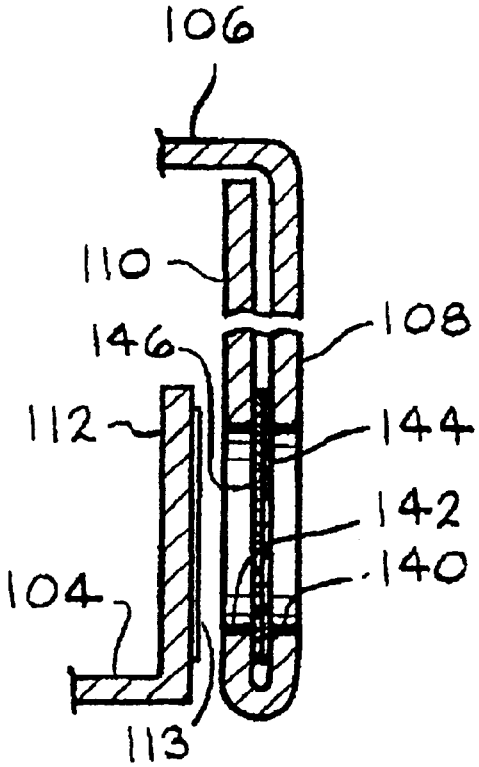
Figure 4B:
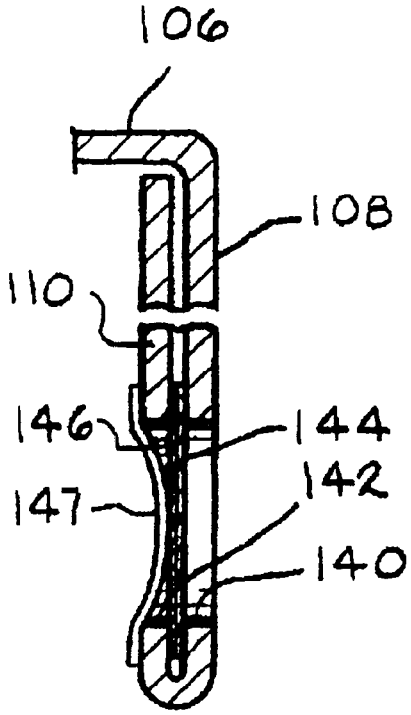
Figure 4C:
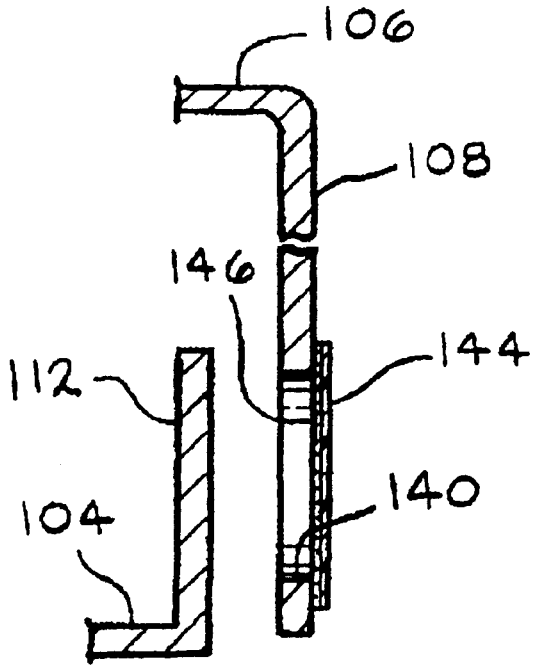

The structure, operation, and advantages of the present preferred embodiment of the invention will become further apparent upon consideration of the following description taken in conjunction with the accompanying drawings, wherein:

FIG. 1 is a plan view of an embodiment of a carton blank, according to the invention;

FIG. 2 is a perspective view, partially broken away of a carton assembled from the carton blank of FIG. 1, with its flap open, according to the invention;

FIG. 3 is a perspective view of the carton of FIG. 2, with its flap closed, according to the invention;

FIG. 3A is a partial cross-sectional view of a portion of the carton shown in FIG. 3, taken on a line 3A—3A through FIG. 3, according to the invention;

FIG. 4A is a partial cross-sectional view of an alternate embodiment of a portion of a carton, comparable to the view of FIG. 3A, according to the invention;

FIG. 4B is a partial cross-sectional view of an alternate embodiment of a portion of a carton, comparable to the view of FIG. 3A, according to the invention; and FIG. 4C is a partial cross-sectional view of an alternate embodiment of a portion of a carton, comparable to the view of FIG. 3A, according to the invention.

DETAILED DESCRIPTION OF THE INVENTION

FIG. 1 illustrates a carton blank 100 for a folding carton of the present invention. The carton blank 100 may be die cut from paperboard stock, and generally comprises a plurality of panels which are defined and foldably connected to one another by a plurality of creases or score lines. The various panels of the carton blank 100 are described in greater detail hereinbelow. FIG. 1 generally shows the outside surface of the assembled folding carton 150 shown in FIGS. 2 and 3.

A back panel 102 is generally rectangular, has four sides, 102*a*, 102*b*, 102*c*, 102*d*, and has a height H1 and a width W1. The height H1 and width W1 of the panel 102 correspond (and are substantially equal) to the height H and width W of the assembled carton 150 shown in FIG. 2.

A bottom panel 104 is generally rectangular, has four sides, 104*a*, 104*b*, 104*c*, 104*d*, and has a height H2 and a width W1. The panel 104 is foldably connected to the panel 102 at its side 104*b* which is substantially coincident with the side 102*d* of the panel 102. The sides 104*b* and 102*d* are suitably a score line. The height H2 of the panel 104 corresponds (and is substantially equal) to the depth D of the assembled carton 150 shown in FIG. 2.

A top panel 106 is generally rectangular, has four sides, 106*a*, 106*b*, 106*c*, 106*d*, and has a height H3 and width W1. The panel 106 is foldable connected to the panel 102 at its side 106*d* which is substantially coincident with the side 102*b* of the panel 102. The sides 106*d* and 102*b* are suitably a score line. The height H3 of the panel 106 is approximately equal to the height H2 of the panel 104.

An outer lid panel 108 is generally rectangular, has four sides, 108*a*, 108*b*, 108*c*, 108*d*, and has a height H4 and a width W1. The panel 108 is foldably connected to the panel 106 at its side 108*d* which is substantially coincident with the side 106*b* of the panel 106. The sides 108*d* and 106*b* are suitably a score line. The height H4 of the panel 108 is suitably equal to, but no greater than, the height H1 of the panel 102.

An inner lid panel 110 is generally rectangular, has four sides, 110*a*, 110*b*, 110*c*, 110*d*, and has a height H5 and a width W1. The panel 110 is foldably connected to the panel 108 at its side 110*d* which is substantially coincident with the side 108*b* of the panel 108. The sides 110*d* and 108*b* are suitably a score line. The height H5 of the panel 110 is suitable equal to, but no greater than, the height H4 of the panel 108. A height H5' for the panel 110 which is a fraction, such as approximately one-half of the height H4 of the panel 108 is illustrated. As described in greater detail hereinbelow, the panels 108 and 110 cooperate to form a single "closure flap" 108/110 for the folding carton 150.

A flap-receiving panel 112, which is a partial front panel for the assembled carton 150, is generally rectangular, has four sides, 112*a*, 112*b*, 112*c*, 112*d*, and has a height H6 and a width W1. The panel 112 is foldably connected to the panel 104 at its side 112*b* which is substantially coincident with the side 104*d* of the panel 104. The sides 112*b* and 104*d* are suitably a score line. The heights H6 of the panel 112 is a fraction, such as approximately one-half, of the height H1 of the panel 102. However, it is within the scope of the invention that the height H6 can be equal to the height H1.

A side panel 114 has four sides, 114*a*, 114*b*, 114*c*, 114*d*, and has a height H1 and overall width W2. The panel 114 is foldably connected to the panel 102 at its side 114*c* which is substantially coincident with the side 102*a* of the panel 102. The sides 114*c* and 102*a* are suitably a score line. A line 116 which may be a fold line or a line of perforations (e.g., cutscores and nicks) extends lengthwise along the paperboard blank 100, parallel to the side 114*c*, and divides the side panel 114 into a generally rectangular side portion 118 which is foldably connected to the panel 102, and a front portion 120. The side portion 118 itself has a height H1 which is equal to the height of the side panel 114, and has a width dimension W2*a* (not shown, which is the distance between the line 116 and the side 114*c*) which is substantially equal to the height H2 of the panel 104. The flap portion has a height substantially equal to H1, and a width dimension W2*b* (not shown, which is the distance between the line 116 and the side 114*a*) which is suitably approximately equal to the width dimension W2*a*.

A side panel 122 has four sides, 122*a*, 122*b*, 122*c*, 122*d*, has a height H1 and an overall width W2. The panel 122 is foldably connected to the panel 102 at its side 122*a* which is substantially coincident with the side 102*c* of the panel 102. The sides 122*a* and 102*c* are suitably a score line. A line 124 which may be a fold line or a line of perforations (e.g., cutscores and nicks) extends lengthwise along the paperboard blank 100, parallel to the side 122*a*, and divides the side panel 122 into a generally rectangular side portion 126 which is foldably connected to the panel 102, and a front portion 128. The side portion 126 itself has a height H1 which is equal to the height of the side panel 122, and has a width dimension W3*a* (not shown, which is the distance between the line 124 and the side 122*a*) which is substantially equal to the height H2 of the panel 104. The flap portion 128 has a height substantially equal to H1, and a width dimension W3*b* (not shown, which is the distance between the line 124 and the side 122*c*) which is suitably approximately equal to the width dimension W3*a*.

A corner panel 130 is generally rectangular, has four sides, 130*a*, 130*b*, 130*c*, 130*d*, and has a height H2 and a width W2*a*. The panel 130 is foldably connected to the panel 104 at its side 130*c* which is substantially coincident with the side 104*a* of the panel 104. The sides 130*c* and 104*a* are suitably a score line. The side 130*b* is separated from the side 114*d* by a slit.

A corner panel 132 is generally rectangular, has four sides, 132*a*, 132*b*, 132*c*, 132*d*, and has a height H2 and a width W3*a*. The panel 132 is foldably connected to the panel 104 at its side 132*a* which is substantially coincident with the side 104*c* of the panel 104. The sides 132*a* and 104*c* are suitably a score line. The side 132*b* is separated from the side 122*d* by a slit.

The overall length L of the carton blank 100 is equal to the sum of the heights of the six panels 102, 104, 106, 108, 110 and 112, described hereinabove—in other words, L=H6+H2+H3+H4+H5.

The overall width W of the carton blank 100 is equal to the sum of the widths of the three panels 102, 114 and 122—in other words, W=W1+W2+W3.

A periphery of the carton blank 100 comprises the sides 106*a*, 108*a*, 110*a*, 110*b*, 110*c*, 108*c*, 106*c*, 122*c*, 132*c*, 112*c*, 112*d*, 112*a*, 130*d*, 130*a* 114*d*, 114*a* and 114*b*.

FIG. 2 illustrates the folding carton 150 which is assembled from the carton blank 100 of FIG. 1. The various panels of the carton blank 100 are folded, as illustrated, to form a three-dimensional carton having height H, width W and depth D dimensions, as described hereinabove. Additionally, some of the panels may be glued to one another with a suitable adhesive (not shown). For example, the front portion 128 of the side panel 122, and the front portion 120 of the side panel 114 are both glued to flap-receiving panel 112.

The panel 110 is folded inward onto the panel 108 to form an overall closure flap 108/110 for the carton 150 which is of double thickness. In FIG. 2, the closure flap 108/110 is shown in an open configuration. In FIG. 3, the closure flap 108/110 is shown in a closed configuration.

Closure Mechanism

A closure mechanism for the assembled carton 150 is provided in the carton blank 100—more particularly, in the closure flap 108/110, as follows. An opening or aperture 140 is provided in the panel 108, at a distance H7 from the side 108*b* of the panel 108, and is preferably centered widthwise between the two sides 108*a* and 108*c* of the panel 108. A corresponding opening or aperture 142 is provided in the panel 110 and, when the panel 110 is folded onto the panel 108 (as best viewed in FIG. 2), the opening 142 is aligned with the opening 140. Therefore, the opening 142 is also preferably at a distance H7 from the side 110*d* of the panel 110, and centered widthwise between the two sides 110*a* and 110*c* of the panel 110. The opening 142 is preferably substantially the same shape and size as the opening 130. It is within the scope of the invention that the openings 140 and 142 are each two or more openings.

A strip of pressure-sensitive tape 144 is disposed on (applied to) the back side (as viewed in FIG. 1) of the carton blank 100, and is shown in dashed lines in FIG. 1. The tape 144 is sized and shaped to completely cover (extend completely across) the opening 142 in the panel 110. The tape 144 has two surfaces, a front surface and a back surface. As best viewed in both FIG. 1 and FIG. 2, an adhesive 146 is disposed on (e.g., coated onto) the front surface of the tape 144. As best viewed in FIG. 3, the back surface of the tape 144 is not tacky (i.e., does not have an adhesive coating). The tape 144 is secured to the back surface of the panel 110 by the adhesive coating 146.

To close the carton 150, the closure flap 108/110 is folded over and pressed against the flap-receiving panel 112 of the carton 150. The opening 140 in the panel 108 is preferably large enough to permit a user to insert a finger into the opening 140 to apply pressure to the non-tacky side of the tape 144. In this manner, the portion of the tape 144 which is exposed through the opening 142 in the panel 110 will engage a corresponding underlying portion of the outer surface of the panel 112 of the carton 150. As best viewed in FIG. 3A, the tape 144 is disposed between the folded-over inner and outer lid panels 108 and 110, and the adhesive 146 on the tape 144 is exposed through the opening 142 in the inner lid panel 110. To seal the carton 150, the user (not shown) would apply pressure to the non-sticky side of the tape 144 through the opening 140 in the outer lid panel 108.

The strip of pressure-sensitive tape 144 is suitably a thin film of material such as polyethylene, paper, or aluminum foil which has a pressure-sensitive adhesive coating 146 on one surface thereof. The tape 144 is suitably ordinary adhesive tape, such as the one known by the trademark "SCOTCH TAPE".

Optionally, as shown in FIG. 4A, at least the portion of the panel 112 to which the pressure-sensitive tape 144 adheres can be provided with a relatively high gloss surface, in the way of a varnish or coating, or a plastic film 113 applied to the surface of the panel 112, in order to optimize the adhesion and release properties of the closure flap 108/110. In this manner, when the exposed adhesive 146 of the tape 144 comes in contact with the glossy surface of the panel 112, a good reliable bond will result, and when the closure flap 108/110 is opened, the glossy surface will retain very little or no tacky material from the pressure-sensitive adhesive tape 144.

Optionally as shown in FIG. 4B, a peelable strip 147, such as waxy-paper or mylar film can be disposed on the inside surface of the flap 108/110, across the opening 142 to protectively mask the exposed adhesive 146, and would be peeled off before sealing the flap 108/110.

Optionally, the height of the panel 110 may be shortened (to be H5) to only that which is sufficient to define the opening 142. In a similar manner, the width of the panel 110 may be narrowed to that which is sufficient to define the opening.

Optionally, as shown in FIG. 4C, the panel 110 can be omitted. In such a case, the pressure-sensitive tape 144 would be applied directly across the opening 140 in the panel 108, on the front surface of the blank 100 (the visible surface in FIG. 1) with the adhesive 146 oriented towards the back surface (the not visible surface in FIG. 1), so that the adhesive 146 is exposed through the opening 140 and contacts the panel 112 when the panel 108 functioning as the closure flap is closed. This results in a single ply lid instead of a double ply lid, and the edges of the tape, are not to be hidden from view as they are in the double ply lid construction described hereinabove. In either case, single ply or double ply lid, the tape 144 extends across the opening 140 and is oriented so as to adhere to the outer surface of the flap-receiving panel 112. The tape 144 is adhered to a one surface of the panel 108 oriented with the adhesive 146 towards the opposite surface of the panel 108 and, if a peelable strip (e.g., 147) were used in this embodiment, it would be on the opposite surface of the panel 108 extending across the opening 140.

Materials and Dimensions

The carton blank 100 and assembled carton 150 may be formed of the following exemplary materials and may have the following approximate dimensions (expressed in both inches and millimeters (mm)). These materials and dimensions are not intended to be limiting—other materials and dimensions being within the scope of the invention.

The carton blank 100 is formed of a material selected from the group consisting of paperboard, cardboard, fiberboard, containerboard, boxboard, tagboard and corrugated board. The carton blank is preferably made of "paperboard" or Solid Bleached Sulfate (SBS), but may also be formed of Clay-Coated Recycled Boxboard (CRB) or Uncoated Recycled Board (URB).

The carton blank 100 has a thickness of at least 0.010 inches (0.25 mm), preferably approximately 0.018 inches (0.46 mm), preferably no greater than 0.024 inches (0.60 mm).

The carton blank 100 may have the following exemplary dimensions:

W1=approximately 1.81 inches, or 46 mm;

W2=approximately 0.9 inches, or 23 mm;

W3=approximately 0.9 inches, or 23 mm;

H1=approximately 2.25 inches, or 57 mm;

H2=approximately 0.47 inches, or 12 mm;

H3=approximately 0.50 inches, or 13 mm;

H4=approximately 2.31 inches, or 59 mm;

H5=approximately 2.25 inches, or 57 mm;

H5'=approximately 1.00 inches, or 25 mm;

H6=approximately 0.88 inches, or 22 mm; and

L=approximately 8.66 inches, or 220 mm.

The assembled carton 150 may have the following exemplary dimensions:

H=approximately 2.25 inches, or 57 mm;

W=approximately 1.81 inches, or 46 mm; and

D=approximately 0.50 inches, or 13 mm.

The assembled carton 150 may have the following exemplary ratios of dimensions:

H/W=approximately 1.25 (125%);

W/H=approximately 0.80 (80%);

D/H=approximately 0.22 (22%); and

D/W=approximately 0.28 (28%), from which it becomes apparent that:

the height H and width W dimensions are approximately equal to one another (one is less than ten times the other);

and the depth D is a substantial fraction, such as greater than one-tenth of the lesser of the height H and width W dimensions.

The tape 144 is suitably a thin (approximately 0.001 inches, or 0.025 mm) plastic strip with adhesive 146 on only one side thereof.

The present invention is useful for containing products in a carton that is readily opened and closed by the consumer. The closure mechanism of the present invention is suitable for readily being applied automatically.

While the invention has been described in combination with embodiments thereof, it is evident that many alternatives, modifications, and variations will be apparent to those skilled in the art in light of the foregoing description. Accordingly, it is intended to embrace all such alternatives, modifications and variations as fall within the spirit and scope of the appended claims.

What is claimed is:

1. A carton blank for a folding carton, comprising:

a back panel;

a bottom panel foldably connected to a one side of the back panel;

a flap-receiving panel foldably connected to a one side of the bottom panel a top panel foldably connected to an other side of the back panel;

an outer lid panel foldably connected to a one side of the top panel;

a first opening in the outer lid panel; and a pressure-sensitive tape extending across the opening on a one surface of the outer lid panel, an inner lid panel foldably connected to a one side of the outer lid panel;

a second opening in the inner lid panel; and the pressure sensitive tape applied to said one surface of the inner lid panel and extending across the second opening.

2. A carton blank, according to claim 1, wherein:

the second opening is substantially the same shape and size as, and in register with, the first opening.

3. A carton blank, according to claim 1, further comprising:

a peelable strip disposed across the second opening on an opposite surface of the inner lid panel.

4. A folded carton having a flap-receiving panel, a closure flap and a closure mechanism, said closure mechanism comprising:

a pressure sensitive tape having an adhesive on one side thereof and extending across an opening in the closure flap, said closure flap comprising an outer lid panel having a first opening and an inner lid panel having a second opening, the outer and inner lid panels being folded over one another to form a double ply closure flap.

5. A carton, according to claim 4, wherein: the pressure-sensitive tape is disposed between the inner and outer lid panels.

* * * * *